US008354970B2

(12) United States Patent
Armbrecht et al.

(10) Patent No.: US 8,354,970 B2
(45) Date of Patent: Jan. 15, 2013

(54) DIELECTRIC ANTENNA

(75) Inventors: Gunnar Armbrecht, Hannover (DE); Christian Zietz, Neustadt (DE); Eckhard Denicke, Gilten (DE)

(73) Assignee: KROHNE Messtechnik GmbH, Duisburg (DE)

( * ) Notice: Subject to any disclaimer, the term of this patent is extended or adjusted under 35 U.S.C. 154(b) by 420 days.

(21) Appl. No.: 12/786,717

(22) Filed: May 25, 2010

(65) Prior Publication Data

US 2010/0295745 A1 Nov. 25, 2010

(30) Foreign Application Priority Data

May 25, 2009 (DE) ..... 10 2009 022 511

(51) Int. Cl.
*H01Q 13/00* (2006.01)

(52) U.S. Cl. ..... 343/785; 343/786; 343/772

(58) Field of Classification Search ..... None
See application file for complete search history.

(56) References Cited

U.S. PATENT DOCUMENTS

| | | | | |
|---|---|---|---|---|
| 2,801,413 | A | 7/1957 | Beck | |
| 4,210,915 | A | 7/1980 | Kienberger et al. | |
| 5,486,839 | A | 1/1996 | Rodeffer et al. | |
| 5,642,121 | A * | 6/1997 | Martek et al. | 343/786 |
| 6,005,528 | A * | 12/1999 | Preiss et al. | 343/786 |
| 6,320,554 | B1 | 11/2001 | Yuanzhu | |
| 6,353,417 | B1 | 3/2002 | Yanzhu | |
| 6,661,389 | B2 | 12/2003 | Griessbaum et al. | |
| 7,474,271 | B2 | 1/2009 | Nagano et al. | |

FOREIGN PATENT DOCUMENTS

| | | |
|---|---|---|
| DE | 1 904 130 | 7/1970 |
| DE | 94 12 243 U1 | 9/1994 |
| DE | 44 32 687 A1 | 3/1996 |
| EP | 2 105 991 A1 | 9/2009 |
| GB | 656 200 A | 8/1951 |

(Continued)

OTHER PUBLICATIONS

Gunnar Armbrecht et al., Dielectric Travelling Wave Antennas Incorporating Cylindrical Inserts With Tapered Cavities, Antennas and Propagation, 2009. EUCAP 2009. 3rd European Conference on, IEEE, Piscataway, NJ, USA, Mar. 23, 2009, pp. 3090-3094, XP031470431, ISBN: 978-1-4244-4753-4.

(Continued)

*Primary Examiner* — Anh Tran
(74) *Attorney, Agent, or Firm* — Roberts Mlotkowski Safran & Cole, P.C.; David S. Safran

(57) ABSTRACT

Described and shown is a dielectric antenna (1) having a dielectric feeding section (2), a first transition section (3) comprising a dielectric rod, a dielectric emitting section (5) and, a further, second transition section (4) forming a dielectric horn, wherein the feeding section (2) can be struck with electromagnetic radiation (6), electromagnetic radiation (6) can be guided with the first transition section (3) and the second transition section (4) and the electromagnetic radiation can be emitted from the emitting section (5) as airborne waves.

The object of the present invention is to provide a dielectric antenna, which is adaptable as low-loss as possible to different mounting situations, which additionally is as low-reflection as possible and, at the same time is highly bundling.

The object of the above-mentioned dielectric antenna is met in that the emitting section (5) is designed as dielectric tube connecting to the second transition section (4).

20 Claims, 5 Drawing Sheets

FOREIGN PATENT DOCUMENTS

| | | | |
|---|---|---|---|
| JP | 4-301902 | A | 10/1992 |
| JP | 2003-304116 | A | 10/2003 |
| WO | 86/05327 | A1 | 9/1986 |

OTHER PUBLICATIONS

J.R. James, Engineering Approach to the Design of Tapered Dielectric-Rod and Horn Antennas, The Radio and Electronic Engineer, Institution of Electronic and Radio Engineers. London, GB, vol. 42, No. 6, Jun. 1, 1972, pp. 251-259, XP 000575262, ISSN: 0033-7722.

German Examination Report Dated Mar. 9, 2010 From Corresponding German Application No. 10 2009 022 511.0-35.

European Search Repot Dated Feb. 25, 2011 From Corresponding European Application No. 10 004 964.2.

* cited by examiner

DIELECTRIC ANTENNA

BACKGROUND OF THE INVENTION

1. Field of the Invention

The invention relates to a dielectric antenna having a dielectric feeding section, a first transition section comprising a dielectric rod, a dielectric emitting section, and, a further, second transition section forming a dielectric horn and, wherein the feeding section can be struck with electromagnetic radiation, electromagnetic radiation can be guided with the first transition section and the second transition section and the electromagnetic radiation can be emitted from the emitting section as airborne waves.

2. Description of Related Art

Dielectric antennae per se have been known for a long time and are used in different forms and sizes for very different purposes, as, for example, also in industrial process control for determining distances—for example of media surfaces in tanks—using running time evaluation of reflected electromagnetic waves (radar applications). The invention described here is completely independent of the field in which the following antennae are used; the application in the field of fill level measurement for the antennae being discussed here is only exemplary in the following.

In dielectric antennae known from the prior art, the emitting section and the second transition section forming a dielectric horn overlap and are normally called horn antennae—or also horn emitter in the case of emission. Such a dielectric antenna is supplied by a metallic waveguide with a TE-wave or a TM-wave, as e.g. $TE_{11}$-wave (same as a $H_{11}$-wave), whose electric field intensity has no share in the transmission direction of the electromagnetic wave. The electromagnetic wave guided by the waveguide transmits itself via the dielectric feeding section into the first transmission section comprising the dielectric rod and from there into the second transmission section forming a dielectric horn and is guided further to the antenna aperture of the second transmission section, which forms the emitting section in this case, and is emitted via this antenna aperture into the room as a free wave. As opposed to the widespread horn antennae having metallic walls, dielectric antennae consist essentially of a body of the dielectric material, wherein electromagnetic waves are also guided in the material and are emitted in the direction of emission via the material. "Direction of emission" is meant here essentially to be the main direction of emission of the dielectric antenna, i.e. the direction in which the directivity of the dielectric antenna is particularly pronounced.

Dielectric antennae are often used in industrial process measurement—as was mentioned in the introduction—for fill level measurement. It is of particular advantage for such applications when theses antennae have a thin as possible main direction of emission and, at the same time, a compact as possible construction. These demands, however, are contradictory in view of constructive measures that normally occur in their technical implementation.

A thin directivity in the main direction of emission can be first achieved using a large antenna aperture—thus opening surface—of the emitting section, which makes a large extension of the antenna necessary perpendicular to the main direction of emission. So that the antenna aperture is also used in the sense of a thin main direction of emission, the electromagnetic radiation emitted from the emitting section has to have an even as possible phase front, wherein such an even phase front can only, for the most part, be implemented with increasing length of the antenna, which is also contradictory to the desired compact construction. In the field of fill level measurement, an additional problem also occurs in that the geometric antenna aperture can only be enlarged within narrow bounds, since the antenna cannot be otherwise introduced in the capacity to be monitored—e.g. via already existing tank openings and spouts—and can no longer be mounted there. Furthermore, electromagnetic waves—due to the geometric conditions of the mounting situation—have to be guided through mounting geometries with low radiation in order to avoid parasitic in-tank reflection, which lead to a distortion of the wanted signal.

SUMMARY OF THE INVENTION

It is, thus, the object of the present invention to provided a dielectric antenna, which is adaptable as low-loss as possible to different mounting situations, which additionally is as low-reflection as possible and, at the same time is highly bundling.

The above derived and described object is met according to the invention with a dielectric antenna of the type mentioned above in that the emitting section is designed as a dielectric tube connecting to the second transition section. In the dielectric antenna according to the invention, the second transition section consequently acts as a "real" transition section between bodily separated sections of the dielectric antenna, namely between the first transition section comprising a dielectric rod and the emitting section. The further guiding of the electromagnetic waves via the emission-side dielectric tube has the advantage that, at optimal—i.e. pure-mode—excitation, a substantial variability of the length of the dielectric antenna is achieved.

In an advantageous design of the dielectric antenna according to the invention, it is provided that the wall thickness of the dielectric tube forming the emitting section is chosen at a maximum so that only electromagnetic waves in the hybrid basis mode $HE_{11}$ guided along the dielectric tube can be propagated. It has been seen here, that the rod geometry of the dielectric antenna in the first transition section and the tube geometry in the emitting section of the dielectric antenna represent a natural wave system in an electromagnetic sense, along which each field distribution can be represented as an overlapping of individual natural waves. The basis mode is hybrid in both systems and is called $HE_{11}$-mode. The highest directivity at a given maximum outer diameter of the tube can be achieved with the dielectric tube designed with thin walls according to the invention and, at the same time, a pure-mode guiding of the electromagnetic waves is achieved.

The second transition section, which forms a dielectric horn, consequently represents a wave guide transition between two different natural wave systems, wherein the transitions from the rod-shaped, first transition section to the second transition section and from the second transition section to the dielectric emitting section represent discontinuities for the guided electromagnetic waves, that are sources of field distribution of a higher order. When the modes excited by the discontinuities lie under the cut-off frequency of the natural wave system of the dielectric antenna, the higher modes cannot be guided along the dielectric structures, but the related electromagnetic radiation is directly emitted into space at the location of the discontinuities, which leads to a warping of the phase fronts and thus to a reduction of the directivity.

The above-mentioned phenomena is counteracted by a further advantageous design of the dielectric antenna according to the invention, which is characterized in that the second transition section comprising the dielectric horn has a non-linear inner contour increasingly opening in the direction of emission, wherein this inner contour normally forms the interface of the dielectric horn to one of the spaces surrounded by the dielectric horn. A mode purity with a comparably short second transition section in the axial direction—main direction of emission—can be achieved through the non-linear inner contour of the second transition section surrounding the dielectric horn as opposed to a comparably long-stretched linear second transition section in the axial direction. Using this above-mentioned measure, shortening of the second transition section forming a dielectric horn of more than one third of the length normally needed by a linear horn can be achieved.

Inner contours have been shown to be particularly suitable that can be described by an exponential function with fractional exponents greater than 1, wherein these exponential functions have location coordinates of the antenna running in the main direction of emission as an independent variable. Preferably, a value in the range of 1.09 to 1.13 is chosen as an exponent, particularly preferred is a fractional exponent in the range of 1.10 to 1.12, most preferred is an exponent with essentially the value of 1.11. Here, the point of origin of the above-mentioned location coordinates can be located in the first transition section, which comprises a dielectric rod. In this context, it is of particular advantage when the inner contour of the dielectric horn of the second transition section continues in the dielectric rod forming the first transition section, in particular, namely, is continuous into the dielectric rod forming the first transition section. This means that, in particular, a hollow space within the dielectric antenna continues into the dielectric rod of the first transition section.

The inner contour of the dielectric rod described by an exponential function with fractional exponents greater than 1 is preferred, wherein the exponential function, in turn, has location coordinates pointing in the main direction of emission of the antenna as independent variables and wherein the fractional exponent preferably lies in the range of 1.09 to 1.13, in particular in the range of 1.10 to 1.12 and most preferably is essentially the value 1.11. The discontinuity between the first transition section and the second transition section is at its smallest when the inner contour of the first transition section containing the dielectric rod and the inner contour of the second transition section containing the dielectric horn are described by this same exponential function.

The teaching according to the invention in respect to the inner contour of the first transition section and the inner contour of the second transition section, even separate from the teaching described in the introduction, achieves the desired effect of an increased directivity with a compact construction, i.e. not only in such dielectric antennae that have an emitting section designed as a dielectric tube, nevertheless, both aspects can be advantageously implemented together.

During the development of the above-described dielectric antennae, it was seen that an improvement of the antenna design in respect to the radiation characteristics leads to excellent bundling characteristics, however, internal reflection of electromagnetic radiation can cause interfering signals and the resulting "antenna ringing" can lead to measurement errors. In order to avoid undesired, antenna-inherent reflection, a particularly advantageous design of the dielectric antenna according to the invention is, thus, provided in that the inner contour of the first transition section containing the dielectric rod forms a staged impedance converter according to the principle of a quarter wave transformer in the transition to the feed-side solid rod section, in particular, namely, is continuous into a one-stage impedance converter. It has been seen, that the suppression of reflections can be considerably increased in broad-band without negatively influencing the desired field distribution.

A further, staged, in particular one-stage impedance converter is preferably provided in the transition of the emitting section designed as dielectric tube to the free space. According to a particularly preferred design, it is provided that the dielectric feeding section is designed as a staged impedance converter according to the principle of a quarter wave transformer, in particular two-stage impedance converter, which achieves better results in the transition section of a most-often used, metallic waveguide on the dielectric feeding section than a one-stage impedance converter. The staged impedance converter provided in the dielectric feeding section preferably has an inner contour with a cross-section tapering in the direction of emission, wherein preferably at least one stage is provided with an inner hexagonal profile as inner contour. The inner hexagonal profile is particularly advantageous for mounting purposes, however, it is superior to other forms from an electromagnetic point of view, since it has the largest possible robustness compared with unknown rotation angles.

A significant improvement of the transient reflection behavior can be achieved with a further constructive measure, when, namely, the outer diameter of the feeding section is chosen so that, in the mounted state of the antenna, a radial gap is formed between the feeding section and a feeding waveguide, into which the feeding section extends, in particular wherein the gap extends in the direction of emission essentially over the axial extension—extension in the main direction of emission—of the staged impedance converter formed in the dielectric feeding section. For normal antenna measurements with, for example, a solid rod diameter in the range of 22 mm, a gap width of about 1 mm has proven to be effective.

Also the staged impedance converters provided in the feeding section and in the first transition section lead to a reduction of reflection in dielectric antennae that do not have a dielectric tube as emitting section and are, thus, to be understood insofar as being independent of the features of the emitting section designed as dielectric tube.

A further increase in the directivity can be achieved in a preferred design of the dielectric antenna according to the invention in that the dielectric rod in the first transition section is surrounded by a metallic horn hub opening in the direction of emission of the antenna, wherein the metallic horn hub in particular extends neither in the range of the staged impedance converter formed in the dielectric feeding section nor into the range of the staged impedance converter in the first transition section. Using such a metallic horn hub, the directivity of the dielectric antenna according to the invention can be further increased since the basis mode of the electromagnetic radiation at the end of the metallic horn hub overcouples the desired $HE_{11}$ rod mode causing minimal leakage radiation. The opening inner contour of the metallic horn hub can be designed in different manners, but is preferably designed linearly, since with non-linear inner contours almost no improvement of the radiation can be achieved and linear inner contours can be more easily made.

In detail, there are numerous possibilities for designing and further developing the dielectric antenna according to the invention. Here, please refer to the patent claims subordinate to patent claim 1 and to the description of preferred embodiments in connection with the drawing. The drawing shows:

DETAILED DESCRIPTION OF THE INVENTION

Figure 1:
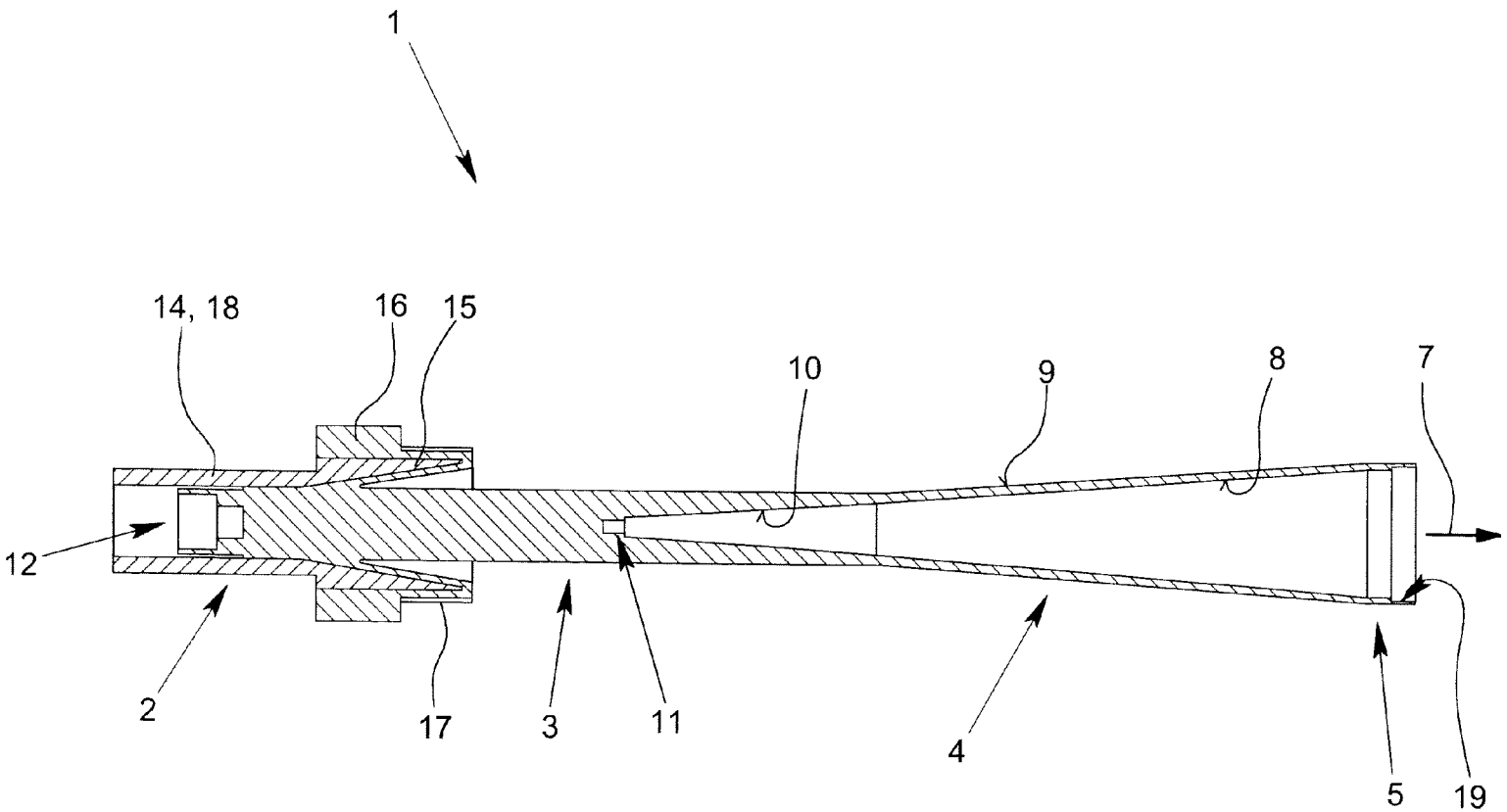
FIG. 1 a cross-section through a first embodiment of a dielectric antenna according to the invention, FIG. 2 a cross-section through a second embodiment of a dielectric antenna according to the invention, FIG. 3 a diagram of a dielectric antenna according to the invention with the entire generated electrical field of the emitted electromagnetic radiation in the E-plane, mode field with parasitic leak field, FIGS. 4*a*, 4*b* the directivity achieved with the embodiment of the dielectric antenna according to the invention compared to the directivity of common antennae and FIG. 5 a cross-section through a dielectric antenna according to the invention in a detailed view.
Figure 2:
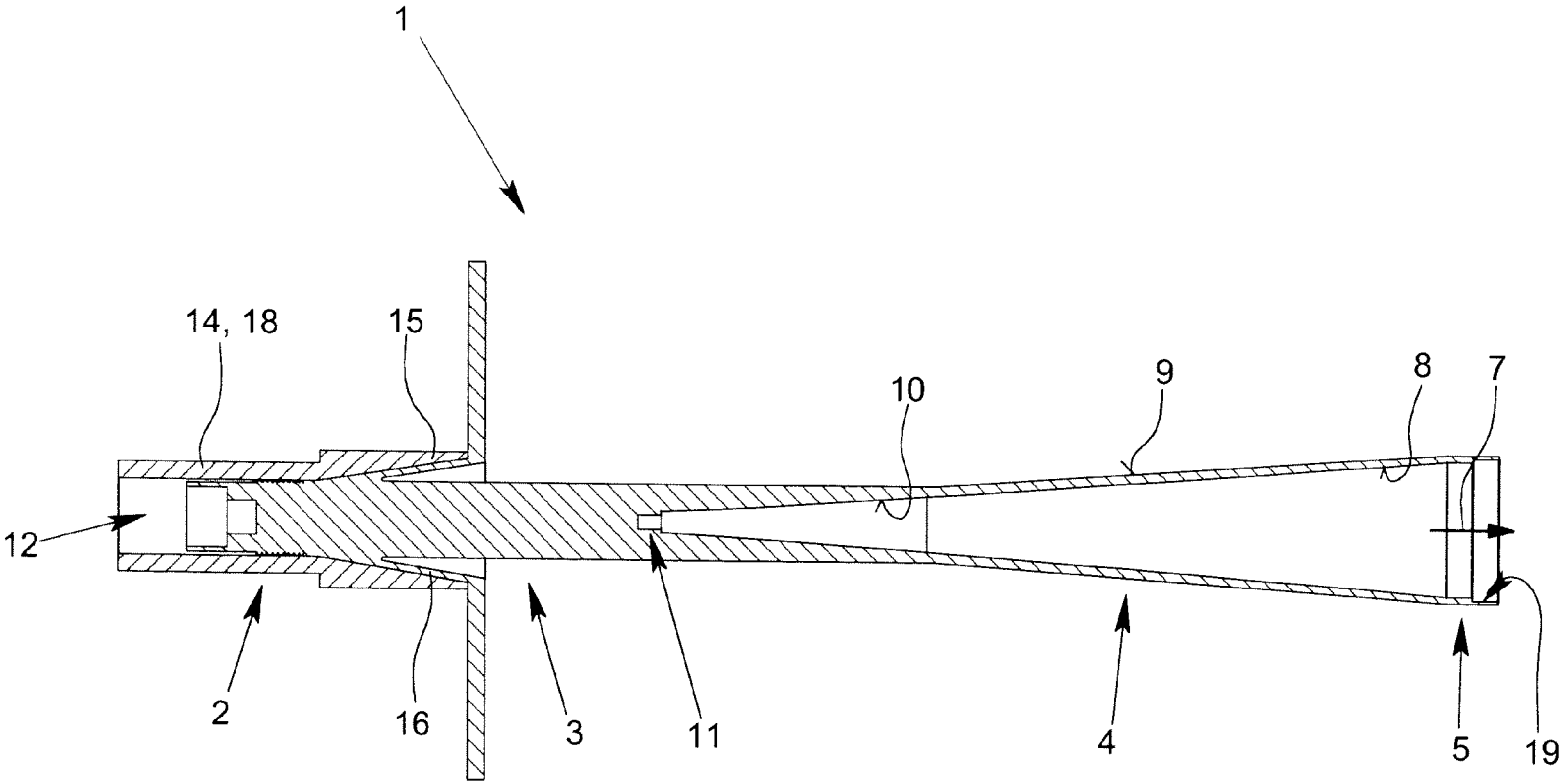

Cross-sections of complete dielectric antennae 1 are represented in FIGS. 1 and 2, which have a dielectric feeding section 2, a first transition section 3 comprising a dielectric rod, a dielectric emitting section 5 and, a further, second transition section 4 forming a dielectric horn, wherein the feeding section 2 can be struck with electromagnetic radiation 6, electromagnetic radiation 6 can be guided with the first transition section 3 and the second transition section 4 and electromagnetic radiation can be emitted from the emitting section 5 as airborne waves.

Figure 3:
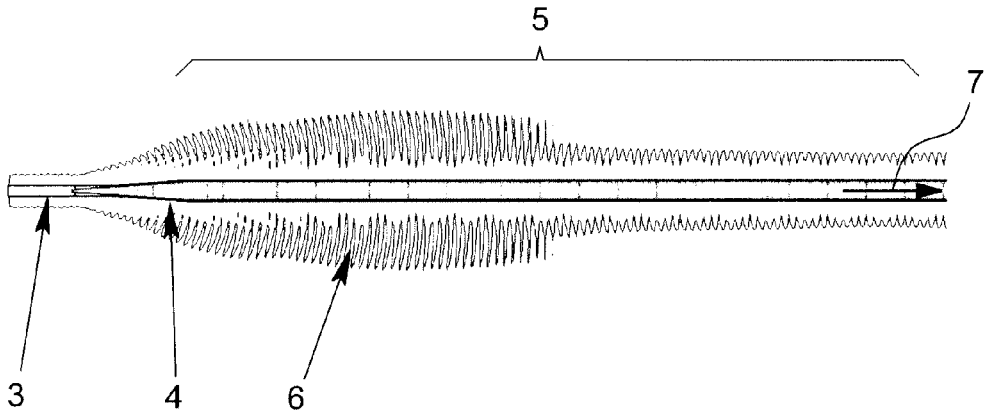

All of the dielectric antennae 1 shown in FIGS. 1 to 3—more or less true to detail—are characterized in that the emitting section 5 is designed as a dielectric tube connected to the second transition section 4. This measure achieves that the length of the dielectric antennae can be varied in large areas, namely using different choices of the length of the first transition section 3 including the dielectric rod and choices of the length of the emitting section 5 designed as dielectric tube. Both sections 3 and 5 are natural wave systems in the electromagnetic sense with the second transition section 4 forming a dielectric horn as waveguide between these different natural wave systems.

In all of the shown embodiments, the wall thickness of the emitting section 5 designed as dielectric rod is chosen so that only electromagnetic radiation 6 lead along the dielectric tube in the hybrid basis mode $HE_{11}$ can be propagated, so that the electromagnetic radiation 6 is guided basically pure mode via the first transition section 3 comprising the dielectric rod and the emitting section 5 designed as dielectric tube. The higher modes occurring on points of discontinuity are immediately emitted into free space at the location of the discontinuities, especially in the area of the second transition section 4 forming a dielectric horn. The detaching of the parasitic electromagnetic leak field can be seen in the representation in FIG. 3, in which the maximum amplitude of the electric field distribution in the E-axis is shown at 9.5 GHz at a length of the emitting section 5 of 1500 mm. This tube length was only chosen (ca. 50λ) for purposes of representation in order to be able to identify a separation between guided and parasitic emitted field, since the wave numbers from the guided mode and airborne field only differ a little.

In the embodiments shown in FIGS. 1 and 2, the wall thickness of the dielectric tube of the emitting section 5 accounts for less than 5% of the outer diameter of the tube. In the present case, the outer diameter of the tube amounts to 43 mm at a wall thickness of 2.0 mm, which, in the use of polypropylene (PP, FIG. 1) and at an excitation frequency of 9.5 GHz, leads to the desired selective transmission behavior.

The transmission behavior of the first transition section 3 containing the dielectric rod to the emitting section 5 designed as dielectric tube is improved in the shown embodiments according to FIGS. 1 and 2 in that the second transition section 4 comprising the dielectric horn has a non-linear inner contour 8 increasingly opening in the direction of emission 7, wherein the inner contour 8 is described by an exponential function having fractional exponents>1 in dependence of the location coordinate in the main direction of emission 7 of the antenna; presently, the exponent has the value of essentially 1.1.

It has been seen that such second transition sections 4 designed as dielectric horns can be formed substantially shorter for attaining a certain directivity of the dielectric antenna 1 than dielectric antennae with a dielectric horn as second transition section that has a linear inner contour.

The antennae according to FIGS. 1 and 2 have in common that the second transition section 4 containing the dielectric horn has a linear outer contour 9 opening in the direction of emission 7. It has been shown that the shaping of the outer contour 9 is not decisive in the same measure for the transmission behavior of the second transition section 4 as is the design of the inner contour 8; insofar as the easiest outer contour 9 to make is chosen here.

Of particular importance for the transmission behavior of the shown dielectric antennae 1, is, however, that the inner contour 8 of the dielectric horn of the second transition section 4 continues in an inner contour 10 of the dielectric rod forming the first transition section 3, presently, namely, is continuous into the dielectric rod forming the first transition section 3. In the shown embodiments, the inner contour 10 of the first transition section 3 comprising the dielectric rod and the inner contour 8 of the second transition section 4 comprising the dielectric horn are described using the same exponential function, through which all irregularities in the transition section between the first transition section 3 and the second transition section 4 are avoided. In the present case, the inner contours 8, 10 are described by the following equation:

$$r(x)=16.5\text{ mm}*(x/230\text{ mm})^{1/0.9}+3\text{ mm}$$

wherein x is the location coordinate in the direction of emission 7 of the antenna and can be given in millimeters and r(x) denotes the height of the inner contours 8, 10 over the axis of the independent location coordinate x. The point of origin of the location coordinate x lies, here, 80 mm inside of the transition from the first transition section 3 to the second transition section 4, wherein the second transition section 4 designed as dielectric horn has a extend of 150 mm in total in the direction of emission 7. The emitting section 5 connecting thereto designed as dielectric tube has only an extend of 15 mm in the direction of emission 7 of the dielectric antenna 1.

The following chart 1 shows the transmission behavior and characteristic radiation variables at excitation of short emitting sections 5 designed as dielectric tube with different transition sections 4 designed as dielectric horn at an excitation of 9.5 GHz.

CHART 1

Transmission behavior of different linear inner contours and a non-linear inner contour of a dielectric antenna at 9.5 GHz

| Contour | Transmission in the use | | | H-plane | | E-plane | |
|---|---|---|---|---|---|---|---|
| lenth/mm | mode | linear dB | Dir./dBi | SLS/dB | HPBW/° | SLS/dB | HPBW/° |
| linear | | | | | | | |
| 150 | 0.883 | −1.081 | 18.5 | 27.5 | 22.5 | 39.4 | 25.1 |
| 350 | 0.936 | −0.574 | 19.7 | 30.4 | 19.4 | 40.5 | 21.3 |
| 550 | 0.957 | −0.382 | 20.0 | 30.4 | 18.3 | 40.5 | 19.8 |
| non-linear | | | | | | | |
| 230 | 0.935 | −0.584 | 20.3 | 28.3 | 19.2 | 21.1 | 19.9 |

In chart 1, the transmission behavior and characteristic radiation variables are shown (Dir.=directivity, SLS=side lobe suppression; HPBW=half power beam width) for three different-length inner contours 8, 10 within the dielectric rod of the first transition section 3 and within the second transition section 4 forming a dielectric horn for a linear inner contour (150 mm, 350 mm and 550 mm) and for an improved non-linear inner contour (230 mm as sum of a 80 mm long first transition section 3 and a 150 mm long second transition section 4) at an excitation of an emitting section 5 designed as short tube (50 mm) at an excitation of 9.5 GHz. It can be easily seen, that a length of 230 mm in a non-linear inner contour 8, 10 about the same transmission and directivity can be achieved as in a linear inner contour, which, however, is longer (350 mm). In the non-linear inner contour, the higher directivity (here, ca. 0.5 dB) is achieved as opposed to a longer linear transition (350 mm) at a similar $HE_{11}$ mode purity. This is presently possible due to specific abandoning of a particularly clear side lobe suppression (SLS) from more than 20 dB in the E-plane. This is acceptable since, due to an even lower level of the suppression, a significant improvement of the measuring accuracy is no longer possible.

Figure 4A:
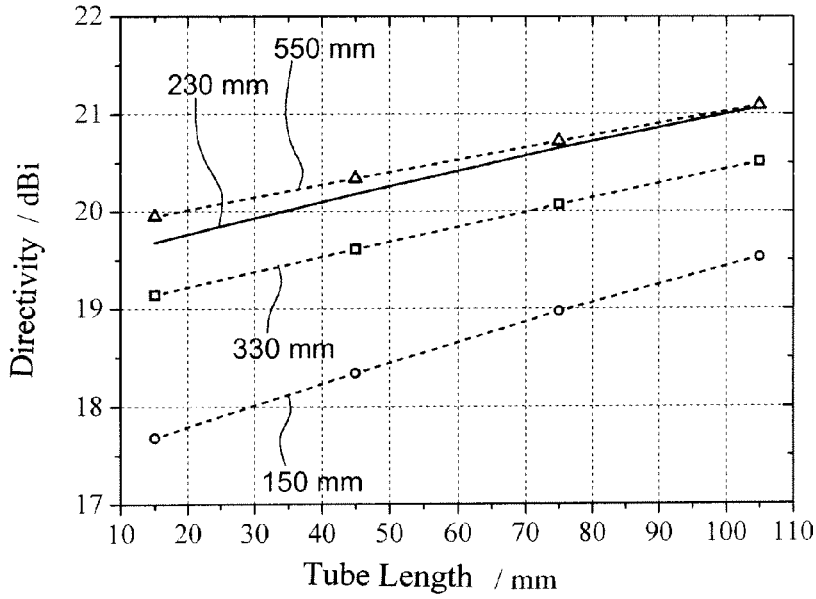
Figure 4B:
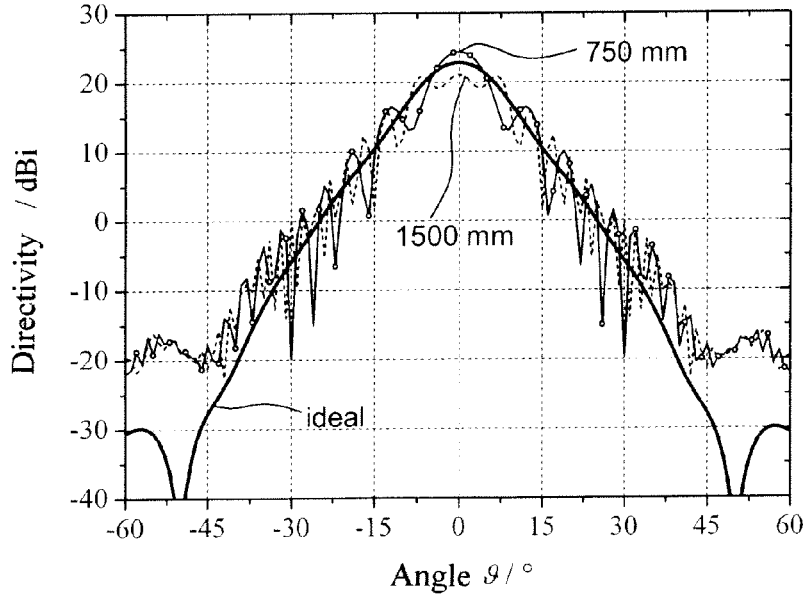

The diagrams in FIGS. 4*a* and 4*b* are to be understood together with the results from chart 1. In FIG. 4*a*, the directivity is dependent on the length of the second transition sections 4 designed as dielectric tube and, namely, for the second transition section 4 designed as dielectric horn having a linear inner contour (150 mm, 350 mm, 550 mm) and for the excitation of an emitting section 5 with a changeable length via a second transition section 4 designed as dielectric horn with a non-linear inner contour (230 mm). An increase of the $HE_{11}$ mode purity leads to a decrease of the directivity increasing over the length of the tube and therewith to a reduced length dependency of the radiation behavior. If the transmission in the use mode, as in the case of the second transition section 4 with a non-linear inner contour (350 mm) and in the case of the second transition section 4 with a non-linear inner contour (230 mm) is of the same size, then the directivity curves run nearly parallel to one another. The course is, however, steeper at a low transmission (150 mm) and flatter at a higher transmission (550 mm). In FIG. 4*b*, the far-fields are shown from the arrangement known from FIG. 3 with a tube length of the emitting section 5 of 1500 mm and 750 mm as well as the ideal mode field. As can be gathered from FIG. 4*b*, the effect described is a parasitic overlapping effect of two emitted cross-sections, since the increase of directivity only occurs due to the constructive overlapping of the $HE_{11}$ mode field with the parasitic leak field emitting in the area of the horn-shaped second transition section 4. Since both parts of the field have nearly the same number of waves, the entire effect can first be seen at greater lengths of the emitting section 5 designed as tube, i.e. when the directivity falls again, refer here, please, once again to the field distribution shown in FIG. 3.

In order to decrease internal reflection in the dielectric antenna 1, different staged impedance converters are formed within the dielectric antenna 1, which work according to the principle of a quarter wave transformer. In this manner, a first, staged impedance converter 11 is formed by the inner contour 10 of first transition section 3 comprising the dielectric rod in the transition to the feed-side solid rod area, which in the present case is formed as a one-stage impedance converter. One-stage impedance converters lead to good results in pure dielectric transition sections in view of avoiding internal reflection. Furthermore, it is provided in the dielectric antennae 1 according to FIGS. 1 and 2 that the dielectric feeding section 2 is formed as a further staged impedance converter 12, which also works according to the principle of a quarter wave converter. Here, the staged impedance converter 12 has a inner contour with a cross-section tapering in the direction of emission 7, wherein the smallest stage is formed with a inner hexagonal profile as inner contour, which is an advantage in view of the mounting of the dielectric antenna 1, but also—as described above—is a particularly preferred structure in view of electromagnetic characteristics.

Figure 5:
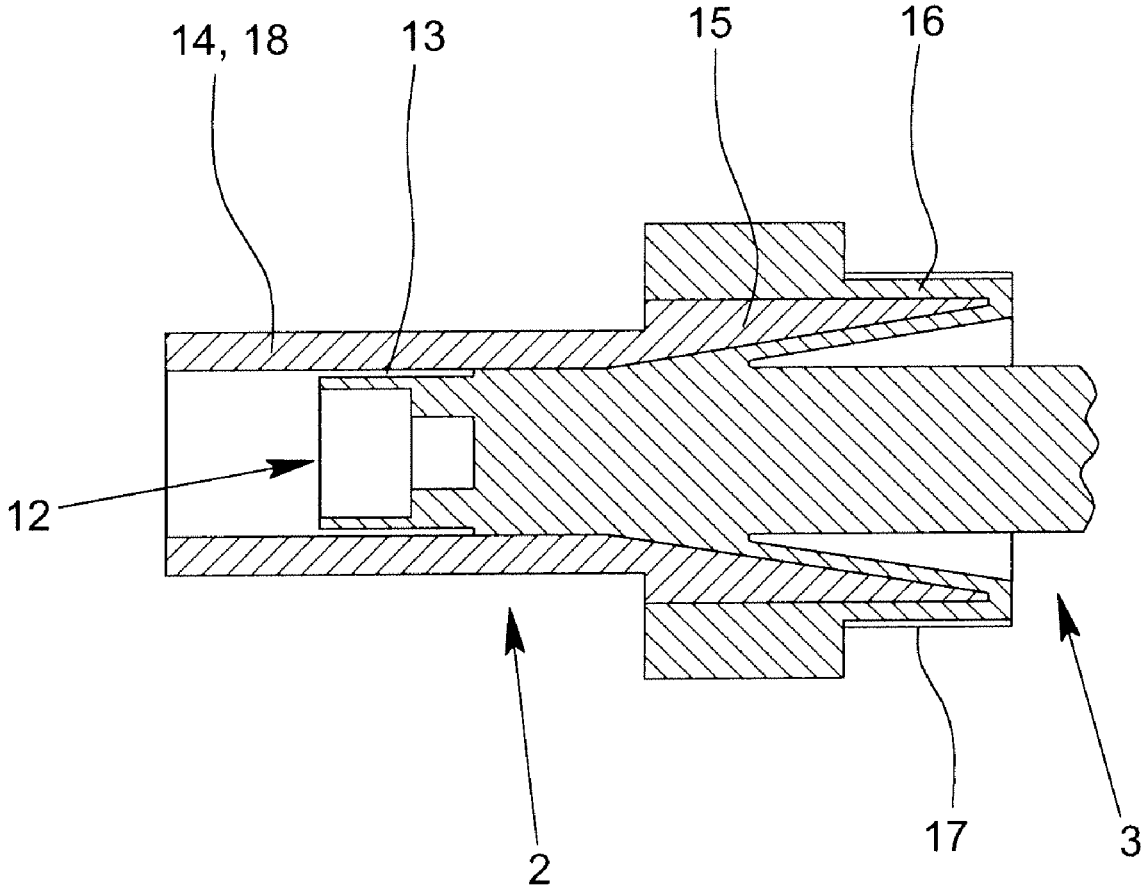

It is of particular importance in the staged impedance converter 12 provided in the dielectric feeding section 2 that the outer diameter of the dielectric feeding section 2 is chosen so that, in the mounted state of the antenna, a radial gap 13 is formed between the feeding section 2 and a feeding waveguide 14, into which the feeding section 2 extends, wherein, presently, the radial gap 13 extends in the direction of emission 7 essentially over the axial extension of the staged impedance converter 12 formed in the dielectric feeding section 2, which can be seen, in particular, in FIG. 5.

A third staged impedance converter 19, which works according to the principle of the quarter wave transformer, is provided on the emitting section 5 designed as tube.

A further measure for increasing directivity, which is implemented in the dielectric antennae according to FIGS. 1, 2 and 5, consists of the dielectric rod being surrounded by a metallic horn hub 15 opening in the direction of emission 7 of the antenna 1 in the first transition section 3, wherein the metallic horn hub 15 extends neither into the range of the staged impedance converter 12 formed in the dielectric feeding section 2 nor into the range of the staged impedance converter 11 in the first transition section 3. Experience shows that metallic horn hubs 15 that exceed the outer diameter of the dielectric rod in the first transition section 3 at a factor of 2 at the most, lead to a noticeable increase of directivity, as, for example, the metallic horn hubs 15 in FIGS. 1, 2, and 5, which have a maximum outer diameter of 40 mm as opposed to an outer diameter of the dielectric rod formed in the first transition section 3 of 22 mm.

Furthermore, it is advantageous in the embodiments according to FIGS. 1 and 5 that the metallic horn hub 15 is surrounded by a dielectric casing 16, wherein the dielectric casing 16 presently joins the metallic horn hub 15 mechanically with the dielectric antenna 1 and affixes the metallic horn hub 15 on the dielectric antenna. Presently, the dielectric casing 16 is integrally formed with the other dielectric parts of the dielectric antenna 1, they are formed, namely by injection molding on the dielectric antenna 1. The dielectric casings 16 according to the embodiments in FIGS. 1 and 5 also have an outer threading 17 for mounting the dielectric antenna 1 in a process-side flange, wherein the process-side flange is not shown. The casing 16 in FIG. 1 is designed adjacent to the outer threading 17 as a nut, which, in total, makes the mounting of the antenna 1 easier.

The dielectric casing 16 according to FIG. 2 is additionally designed as an extension vertical to the direction of emission 7 of the antenna 1, which acts as a sealing plate between mounting flanges (not shown); in this manner, explosion- and/or flame-proofing is easily possible—assuming a sufficient thickness or sealing plate.

The dielectric casing 16 is advantageous for all of the shown embodiments in FIGS. 1, 2 and 5 in many ways, which can be practically of substantial importance, as e.g. the casing of all metal parts for the process and the possibility to do without otherwise normal sealing elements within the rod geometry or the waveguide, since the sealing elements can be disadvantageous in view of electromagnetic characteristics.

Further stability and improved electromagnetic transmission behavior are achieved in that—as is shown in FIGS. 1, 2 and 5—a cylindrical metal sleeve 18 is formed on the metallic horn hub 15 in the direction of the feeding section 2, which acts as transition to a feeding, metallic waveguide 14 or represents the feeding waveguide 14 in this section. Further in FIG. 2, a threading formed between the feeding section 2 and the metallic horn hub 15 or the surrounding metal sleeve 18 is indicated in the feeding section 2 of the antenna 1, with which the dielectric part of the antenna is secured in the metallic horn hub 15 or the surrounding metal sleeve 18.

What is claimed is:

1. Dielectric antenna, comprising:

a dielectric feeding section, a first transition section comprising a dielectric rod and a dielectric emitting section for emitting electromagnetic radiation as airborne waves, and a second transition section forming a dielectric horn, wherein the feeding section is adapted to be struck with electromagnetic radiation, wherein the electromagnetic radiation is guidable by the first transition section and the second transition section, and wherein the emitting section is a dielectric tube connected to the second transition section.

2. Dielectric antenna according to claim 1, wherein the dielectric tube has a wall thickness which will propagate only electromagnetic radiation in hybrid basis mode $HE_{11}$ along the dielectric tube.

3. Dielectric antenna according to claim 2, wherein the wall thickness of the dielectric tube is at most 5% of the outer diameter of the dielectric tube.

4. Dielectric antenna according to claim 1, wherein the dielectric horn of the second transition section has a non-linear inner contour that opens increasingly in a direction of emission.

5. Dielectric antenna according to claim 4, wherein the non-linear inner contour is describable by an exponential function with fractional exponents in a range of 1.09 to 1.13 in dependence on location coordinates in the direction of emission of the antenna.

6. Dielectric antenna according to claim 1, wherein the dielectric horn of the second transition section has a linear outer contour opening in a direction of emission.

7. Dielectric antenna according claim 1, wherein the inner contour of the dielectric horn of the second transition section is continuous with an inner contour in the dielectric rod of the first transition section.

8. Dielectric antenna according to claim 7, wherein the inner contour of the dielectric rod is describable by an exponential function with fractional exponents in the range of 1.09 to 1.13 in dependence on the coordinates in a direction of emission of the antenna.

9. Dielectric antenna according to claim 4, wherein the inner contour of the dielectric rod of the first transitional section and the inner contour of the dielectric horn of the second transitional section are described by the same exponential function.

10. Dielectric antenna according to claim 7, wherein inner contour of the dielectric rod of the first transitional section forms a staged impedance converter in a transition to a feed-side solid rod according to the principle of a quarter wave transformer.

11. Dielectric antenna according to claim 1, wherein the dielectric feeding section is a staged impedance converter according to the principle of a quarter wave transformer.

12. Dielectric antenna according to claim 11, wherein at least one stage of the staged impedance converter has an inner contour with a cross section that tapers in the direction of emission.

13. Dielectric antenna according to claim 11, wherein at least one stage of the staged impedance converter has a hexagonal inner profile.

14. Dielectric antenna according to claim 1, wherein the dielectric tube of the emitting section is formed toward a free space as a staged impedance converter according to the principle of a quarter wave transformer, wherein the staged impedance converter has an inner contour with a cross section that increases in a direction of emission.

15. Dielectric antenna according to claim 1, wherein an outer diameter of the feeding section, in a mounted state of the dielectric antenna, forms a radial gap between the feeding section and a feeding waveguide into which the feeding section extends.

16. Dielectric antenna according to claim 1, wherein the first transition section of the dielectric rod is surrounded by a metallic horn hub that opens in a direction of emission of the antenna.

17. Dielectric antenna according to claim 16, wherein the metallic horn hub is outside of a range of a non-continuous impedance converter formed in the dielectric feeding section a range of a staged impedance converter in the first transition section.

18. Dielectric antenna according to claim 17, wherein a maximum outer diameter of the metallic horn hub exceeds an outer diameter of the dielectric rod in the first transition section by at the most a factor of 2.5.

19. Dielectric antenna according to claim 17, wherein the metallic horn hub is surrounded by a dielectric casing.

20. Dielectric antenna according to claim 17, wherein a cylindrical metal sleeve is formed on the metallic horn hub as transition to a feeding, metallic waveguide.

* * * * *